US005956804A

United States Patent [19]

Dunne

[11] Patent Number: 5,956,804

[45] Date of Patent: Sep. 28, 1999

[54] CARPET TACK STRIP

[75] Inventor: Jeffrey W. Dunne, Orange, Calif.

[73] Assignee: Duraplex, Inc., Orange, Calif.

[21] Appl. No.: 08/883,688

[22] Filed: Jun. 27, 1997

[51] Int. Cl.[6] ..... A47G 27/04

[52] U.S. Cl. ..... 16/16; 16/4

[58] Field of Search ..... 16/4, 12, 16

[56] References Cited

U.S. PATENT DOCUMENTS

| | | | |
|---|---|---|---|
| 3,673,633 | 7/1972 | Frebraro | 16/16 |
| 3,858,269 | 1/1975 | Sutton et al. | 16/16 |
| 4,970,754 | 11/1990 | Anderson et al. | 16/16 |
| 5,500,980 | 3/1996 | Morrow et al. | 16/16 |

*Primary Examiner*—Chuck Y. Mah
*Assistant Examiner*—Donald M. Gurley
*Attorney, Agent, or Firm*—Harold L. Jackson

[57] ABSTRACT

An improved carpet tack strip formed from synthetic chemical and natural materials which include a selective amount of a polyethylene material of between 40% to 60% by weight, which is mixed with a selected amount of polypropylene material having about 1% to 10% by weight and including therein a fine powdered wood material having a selected amount of between 60% to about 40% by weight, wherein the mixture thereof is extruded from an extruding apparatus, thereby producing a continuous elongated homogeneous plastic strip that when cooled is cut in predetermined lengths.

22 Claims, 1 Drawing Sheet

CARPET TACK STRIP

BACKGROUND OF THE INVENTION

1. Field of the Invention

The present invention relates generally to a tack strip for securing the peripheral edges of a carpet as it is being anchored to the outer edge of the floor adjacent the walls of a room that is to be covered and more particularly to an improved carpet tack strip that is formed from various ingredients which when mixed together to define a strong polymeric structure. The mixed components are deposited in a mixing hopper of an extruding machine, whereby the resulting compound is heated and molded into an elongated strip that is cooled and cut to selective lengths after which tack-like elements are mounted from the underside of the track so as to project outward from the top surface of the track and extend vertically or angularly upwardly of the top surface.

2. Description of the Prior Art

It is well recognized in the art that problems still exists with numerous carpet fastening devices and often occur with the common wooden assembled carpet strips as well as other know types of carpet securing strips that are made from various plastics and more particularly those made of various plastic compounds that also have a short life expectancy. Accordingly, the most common carpet tack strips are formed as individual narrow elongated strip-like body members that are anchored to the floor along the base of the peripheral walls of a given area such as a room. They are generally secured in a juxtaposed end to end arrangement by means of suitable nails that are driven through the wooden strips and into the floor, whereby the underlying surface of the carpet is readily secured to a multiplicity of hook-like elements that are generally defined by a plurality of tacks or sharp-edged nails that are mounted within each of the wood strips which extend above the top surface of the strip so as to angularly arranged to project inwardly towards the wall adjacent the strips. It should also be noted that many types of wood products have been and are still being used, wherein the wood strips are made from a plywood material. These types of tack strips can be costly because there is a lot of waste material that is generated during the production of plywood strips and if they need to be removed after they are fixed in place they will generally brake into small fragmented pieces. Thus, can only be used once.

There is still a further problem that occurs with wood strips and particularly plywood structured strips in that over the years they begin to deteriorate due to many carpet cleaning operations and the carpet then has a tendency to become separated from the tacks on upper surface side of the strips.

There have been many types of carpet tack strips tried and used that are formed from various plastic polymer materials as a replacement for the wood fastening carpet products. As yet such plastic strips have not been found to be practical or suitable for many types of installations. Some of the polymer materials have not become very popular due to their design configuration and some of these have been found to be more costly than the more commonly employed wood carpet strips. Many are hard to work with during installation of the carpeting particularly in confined areas.

The following U. S. Patents are some examples of various types of carpet tack strips that use different types of plastics and structural arrangements.

In U.S. Pat. No. 3,673,633 defines a carpet tack strip of a plastic material having tack-like elements projecting angularly from the surface and having a spacer means along one edge to provide accurate spacing from the base board. It also includes a metal strip insert in a dovetail.

In U.S. Pat. No. 3,858,269 there is disclosed a tackless carpet stripping for attaching carpets to the floor, being a one-piece integrally molded structure having an elongated member that includes a multiplicity of integrally formed diagonal cross members with each adjacent pair of cross members intersecting at a juncture and being integral with the oppositely disposed side members.

In U.S. Pat. No. 4,970,754 there is disclosed a carpet tack strip having a urethane base in which a plurality of securing tacks are imbedded so as to extend outwardly of the upper surface and wherein one edge of the base is formed having a recessed area or zone that is angularly disposed to permit tucking of the carpet edge under the edge of the strip.

In U.S. Pat. No. 5,500,980 there is disclosed a carpet strip and methods of making the strip that is defined by a polymeric body with a longitudinally extending groove formed in the bottom of the strip body.

SUMMARY AND OBJECTS OF THE INVENTION

In accordance with the present invention there is disclosed a synthetic resinous material that is used to define an improved carpet tack strip that is adapted to be fabricated by an extrusion molding process which provides a resinous compound having a general formulation consisting essentially of polyethylene in which is mixed a wood based powder which can be produced in continuous lengths as it is extruded from a suitable extrusion molding apparatus. As the molded strip is extruded through the hot die it is moved downstream by means of a suitable pulling device through a cooling means provided by air or water which hardens the elongated plastic strip.

The principal object of the present invention is to provide an improved carpet tack strip that in not prone to breakage, whereby the carpet tack strip that is formed from various ingredients which when mixed together to define a strong polymeric structure which consists essentially of polyethylene that is mixed a wood based powder that can be readily formed by an extrusion molding process.

Another object of the invention is to provide an improved carpet tack strip of this character that includes a selective amount of polypropylene material whereby suitable hardness can be established within the fabrication of the carpet strip.

Still another object of the invention is to provide an improved carpet tack strip of this character includes a simple mixture of synthetic resinous materials wherein the components mixed therein will create rigid strip that is capable of limited flexing along its length to correspond to the surface of the flooring on which the caret strip is being installed and yet be able to follow the contour of the base of the wall within a given area.

A further object of the present invention is to provide a carpet tack strip of this character that is relatively inexpensive to manufacture, and is simple and rugged in its structural components and is impervious to water and thus can not rote like the wood carpet strips.

The various features of novelty which characterize the invention are pointed out particularly in the claims annexed to and forming a part of this disclosure. For a better understanding of the invention, its advantages by its use, reference shall be had to the accompanying drawings and descriptive matter in which there are illustrated and described the preferred embodiments of the invention.

BRIEF DESCRIPTION OF THE DRAWINGS

Referring more particularly to the accompanying drawings, which are for illustrative purposes only.

DETAILED DESCRIPTION OF THE INVENTION

Figure 1:
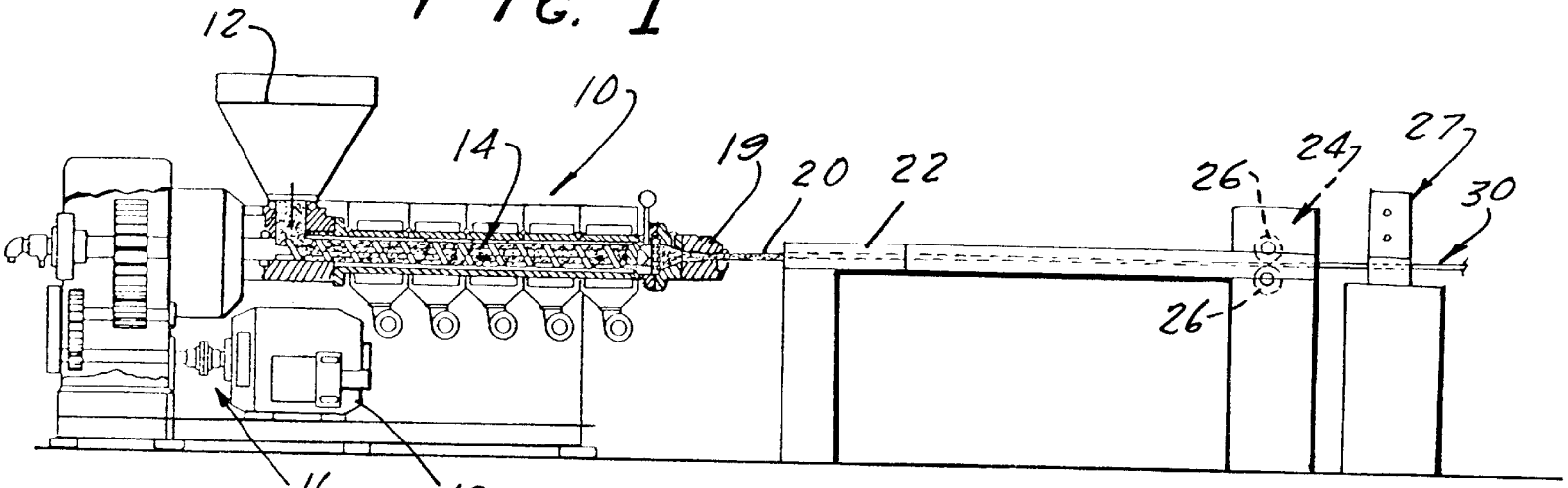
FIG. 1 is a side-elevational view of an extrusion machine with portions thereof broken away and showing the plastic carpet strip being formed thereby.

Referring now to FIG. 1, there is illustrated a conventional extrusion machine, generally indicated at 10, the type commonly employed to extrude polymeric materials and other added ingredients by depositing them in a hopper 12, whereby the elements therein are mixed and introduced into a feeding means 14 that is operated by a typical drive means 16 including a motor 18 and auger 17. The mixed polymeric ingredients are transported downstream so as to be discharged through a hot extrusion mold 19, whereby the hot discharging plastic material is discharged in a suitably shaped configuration to correspond to the proper selected configuration that is indicated by the dimensions as hereinafter described for the improved carpet tack strip.

The still hot flowing polymeric flat elongated strip 20 is passed through a suitable cooling means 22 and is moved further downstream by means of a puller means 24 defined by a pair of rollers 26. The cooling means 22 can be of any known suitable means such as air or water.

From the puller means the elongated strip 20 is now inserted in a cutter means, indicated generally at 27, whereby a continuous number of strips 30 are cut so as to have a pre-selected length of between 3 to 4 feet, which then defines a substantially hardened body member that forms a carpet tack strip that should have a suitable thickness of approximately ¼" to 5/16" and an approximate width of between ¾" and 1½". A multiplicity of special carpet tacks 28 are inserted into the carpet strip from the bottom surface of the strips whereby the pointed end of each tack extends through the top surface for engagement. The tacks are spaced apart in longitudinal alignment with each other as they are inserted in each strip member, either before the strips are selectively cut or preferably after each strip is cut.

Figure 2:
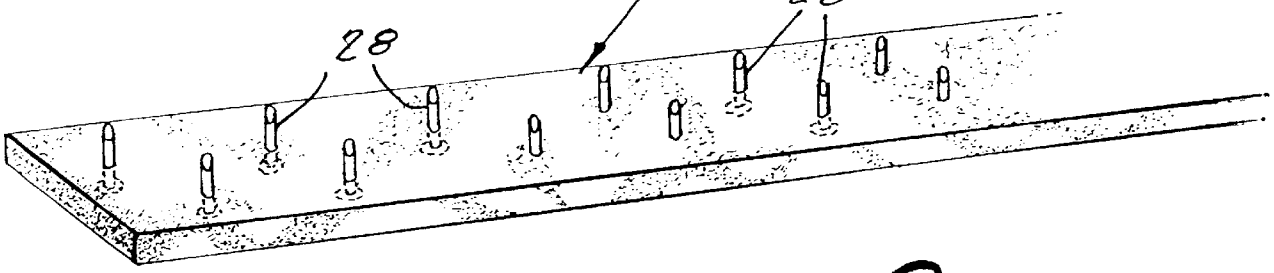
FIG. 2 is a partial perspective view of the finished carpet tack strip as made in accordance with the detailed description that follows herein.

Accordingly, the present invention comprises the improved carpet tack strip, generally indicated at 30, in which an enlarged end thereof is partially shown in FIG. 2.

The mixed components consists of selected amounts of high density polyethers, generally consisting of polyethylene from 60% to 40% by weight and selected amounts of polypropylene from 1% of 10% by weight so as to provide suitable hardness to the strip structure. There is also added a sufficient amount of a fine wood particles of 60% to 40% by weight which is more specifically defined as a fine wood powder having a size of between 5.0 to 10,000 microns. The wood powder allows the wood particles to be readily received and impregnated as evenly as possible during the mixing stage of the combined materials as these materials are deposited together in mixing hopper 12 of the extruding machine 10. The resulting compound is heated and molded to form a high density material that can not be achieved by larger wood shavings used heretofore in some methods of forming such elongated strips for use as carpet tack strips.

It should be noted that it was found that when mixing a 60% by weight powdered wood product with a 40% by weight polyethylene a hard, viable and stable finished product is created. It was also found that by reversing the weight percentages wherein the powdered wood is mixed at 40% by weight and the polyethylene at 60% by weight a still suitable carpet strip is provided. This is mainly accomplished by mixing fine wood powder that provides an exceptional binding material.

It is further contemplated that a suitable blowing agent of between 0% to 2% by weight with a size of between 8 to 12 microns which is used to lighten the weight of the carpet tack strips 30. A blowing agent AZ 180 distributed by Uniroyal Corporation has been found suitable for this purpose.

As indicated herein above, that a the finished harden carpet strip consists of a formulation consisting essentially of the following chemicals and ingredients are examples of a given preparation.

EXAMPLE I

| Component | Percent by Weight |
|---|---|
| polyethylene | 60% to 40% |
| polypropylene | 1% to 10% |
| fine wood particles | 60% to 40% |
| a wood powder having a size of between 5.0 to 10,000 microns | |

EXAMPLE II

| Component | Percent by Weight |
|---|---|
| polyethylene | 40% to 60% |
| polypropylene | 1% to 10% |
| fine wood particles | 60% to 40% |
| a wood powder having a size of between 5.0 to 10,000 microns | |
| a blowing agent of 8 to 12 microns | 0 to 2% |

Thus, it can be readily seen and understood that the present invention is so structured to define a novel carpet tack strip that is readily customized so as to be produced having any appropriate size and strength, and still be lightweight in its structure. The unique qualities of the present invention is that it is also impervious to water and thus will not be affected by dry rot or cracking, when installed in areas having a high humidity such as buildings, motor homes and boats that are located in and around large bodies of water.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the claimed invention.

What is claimed is:

1. A process of forming an improved carpet tack strip that is adapted to support a plurality of substantially equally spaced tack members, wherein said carpet tack strip is formed from a plurality of synthetic chemical materials and natural materials that are mixed and extruded from an extruding means to define a continuous elongated plastic strip which when cooled is cut in selective lengths, whereby said process comprises the steps of:

mixing a selected amount of a polymerized ethylene resin within a hopper of said extruding means;

mixing a selected amount of thermoplastic resin together with said polymerized ethylene resin in said hopper;

mixing a selected amount of a powdered wood product together with both said thermoplastic resin and said polymerized ethylene resin in said hopper, extruding the mixture and thereby producing a continuous elongated extruded homogeneous structure;

cutting said elongated extruded homogeneous structure, and, before or after said step of cutting, attaching a plurality of tack members to the homogeneous structure to form a carpet tack strip having a predetermined selective length.

2. The process as recited in claim 1, wherein said steps of mixing the polymerized ethylene resin and the thermoplastic resin within the hopper comprising mixing a polyethylene material and a polypropylene material within the hopper, respectively.

3. The process as recited in claim 2, wherein the selected amount of said polyethylene material is about 40% to about 60% by weight, wherein the selected amount of said polypropylene material is from about 1% to about 10% by weight, and wherein said powdered wood is about 60% to about 40% by weight.

4. The process as recited in claim 3, wherein the size of said powdered wood is about 5.0 to 10,000 microns.

5. The process as recited in claim 4, including the step of adding a selective amount of a blowing agent of about 0% to 2% and wherein the size of said blowing agent is about 8 to 12 microns.

6. The process as recited in claim 3, wherein the selected amount of said polyethylene material is 60% by weight, wherein the selected amount of said polypropylene material is from about 1% to about 10% by weight, and wherein said powdered wood is about 40% by weight.

7. The process as recited in claim 6, wherein the size of said powdered wood is about 5.0 to 10,000 microns.

8. The process as recited in claim 7, including the step of adding a selective amount of a blowing agent of about 0% to 2% and wherein the size of said blowing agent is about 8 to 12 microns.

9. The process as recited in claim 3, wherein the selected amount of said polyethylene material is 40% by weight, wherein the selected amount of said polypropylene material is from about 1% to about 10% by weight, and wherein said powder wood is about 60% by weight.

10. The process as recited in claim 9, wherein the size of said powdered wood is about 5.0 to 10,000 microns.

11. The process as recited in claim 10, including the step of adding a selective amount of a blowing agent of about 0% to 2% and wherein the size of said blowing agent is about 8 to 12 microns.

12. An improved carpet tack strip supporting a plurality of equally spaced tack members, wherein said carpet tack strip is formed from a plurality of synthetic chemical materials that are mixed together in a hopper and extruded from an extruding means to define a continuous elongated plastic strip which when cooled is cut in selective lengths, whereby said carpet tack strip further comprises:

a selected amount of a polymerized ethylene resin;

a selected amount of thermoplastic resin mixed together with said polymerized ethylene resin in said hopper;

a selected amount of a powdered wood mixed together with both said thermoplastic resin and said polymerized ethylene resin in said hopper of said extrusion means, thereby producing a continuous elongated extruded homogeneous structure, and wherein said elongated extruded homogeneous structure is cut in predetermined selective length to provide a multiplicity of individual carpet tack strips.

13. The carpet tack strip as recited in claim 12, wherein said polymerized ethylene resin comprises a polyethylene material, and wherein said thermoplastic resin comprises a polypropylene material.

14. The carpet tack strip as recited in claim 13, wherein the selected amount of said polyethylene material is about 40% to about 60% by weight, wherein the selected amount of said polypropylene material is from about 1% to about 10% by weight, and wherein said powdered wood is about 60% to about 40% by weight.

15. The carpet tack strip as recited in claim 14, wherein the size of said powdered wood is about 5.0 to 10,000 microns.

16. The carpet tack strip as recited in claim 15, including a selective amount of a blowing agent of about 0% to 2% and wherein the size of said blowing agent is about 8 to 12 microns.

17. The carpet tack strip as recited in claim 13, wherein the selected amount of said polyethylene material is 60% by weight, wherein the selected amount of said polypropylene material is from about 1% to about 10% by weight, and wherein said powdered wood is about 40% by weight.

18. The carpet tack strip as recited in claim 17, wherein the size of said powdered wood is about 5.0 to 10,000 microns.

19. The carpet tack strip as recited in claim 18, including a selective amount of a blowing agent of about 0% to 2% and wherein the size of said blowing agent is about 8 to 12 microns.

20. The carpet tack strip as recited in claim 13, wherein the selected amount of said polyethylene material is 40% by weight, wherein the selected amount of said polypropylene material is from about 1% to about 10% by weight, and wherein said powder wood is about 60% by weight.

21. The carpet tack strip as recited in claim 20, wherein the size of said powdered wood is about 5.0 to 10,000 microns.

22. The carpet tack strip as recited in claim 21, including the step of adding a selective amount of a blowing agent of about 0% to 2% and wherein the size of said blowing agent is about 8 to 12 microns.

* * * * *